United States Patent [19]

Imedio

[11] Patent Number: 4,947,662

[45] Date of Patent: Aug. 14, 1990

[54] ELECTRONIC LOCKING DEVICE

[75] Inventor: Juan A. Imedio, San Sebastian, Spain

[73] Assignee: Talleres de Escoriaza, S.A., Spain

[21] Appl. No.: 356,334

[22] Filed: May 24, 1989

[30] Foreign Application Priority Data

Jun. 1, 1988 [ES] Spain ..... 8801728

[51] Int. Cl.[5] ..... E05B 19/00

[52] U.S. Cl. ..... 70/395; 70/277; 70/408

[58] Field of Search ..... 70/395, 393, 408, 278, 70/277, 276

[56] References Cited

U.S. PATENT DOCUMENTS

| | | | |
|---|---|---|---|
| 3,579,183 | 5/1971 | Lipschutz | 70/395 |
| 3,729,965 | 5/1973 | Gartner | 70/395 |
| 4,562,712 | 1/1986 | Wolter | 70/395 |
| 4,663,952 | 5/1987 | Gelhard | 70/278 |
| 4,734,693 | 3/1988 | Dluhosch | 70/278 |
| 4,791,280 | 12/1988 | O'Connell | 70/278 |

*Primary Examiner*—Robert L. Wolfe

*Attorney, Agent, or Firm*—Lucas & Just

[57] ABSTRACT

The electronic key has a drive head and a turning blade for inserting in a rotor of a lock. The key has an intermediate zone, on the edges of which there are retractile contacts charged by springs in corresponding housings. These retractile contacts are joined to conducting plates that come through the head from the electronic circuit integrated in the drive head itself. On the insertion and turn of the key in the lock these retractile contacts enter into connection with fixed contacts of the corresponding electronic circuit of the lock that are included in the interior wall of an annular extension of the stator in front of the rotor of the lock.

4 Claims, 3 Drawing Sheets

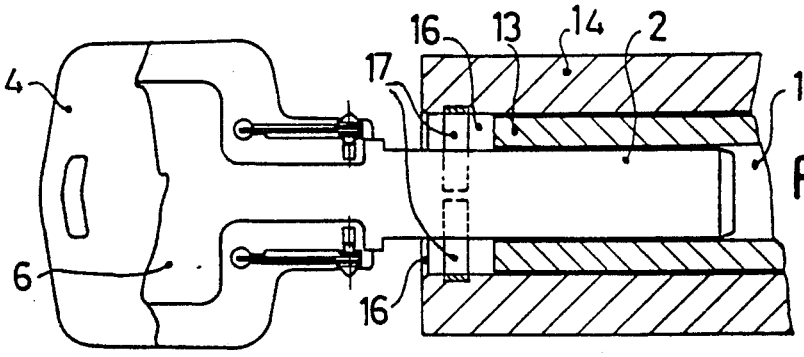
Fig 9
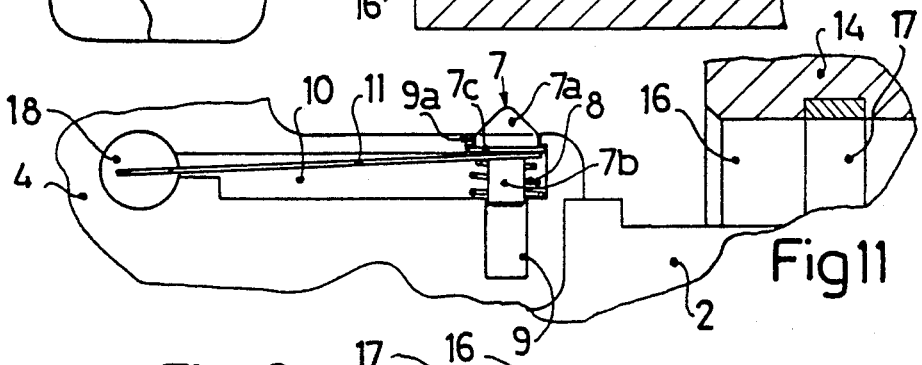
Fig 11
Fig 12
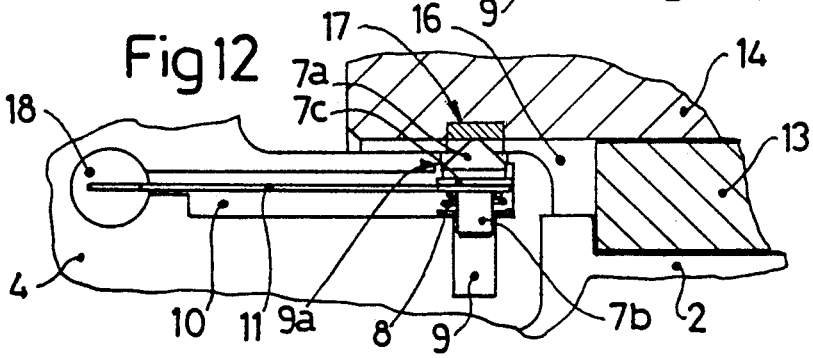
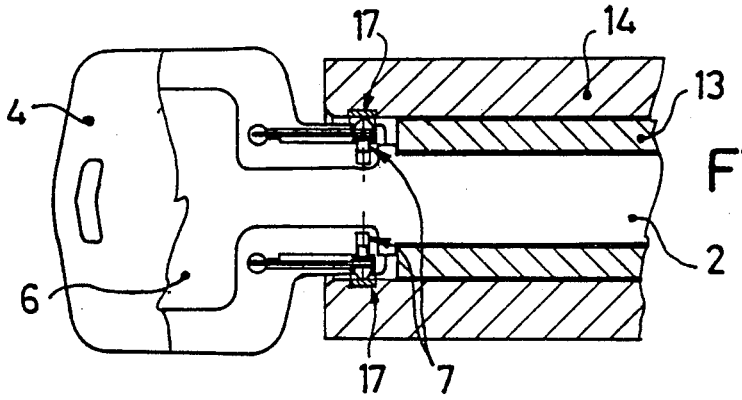
Fig 10

ELECTRONIC LOCKING DEVICE

SCOPE OF THE INVENTION

The term "electronic key" refers, in general, to those keys which, in addition to or instead of operating the usual mechanical bolts of a closure device or lock, are designed to control an electric bolt, release of which is effected by means of the reading of a code or electronic information incorporated in the key, which means that these keys are going to contain a programmable electronic circuit that establishes a dialogue with another circuit existing in the lock, in order to validate the code programmed, thus opening the way for release of the electric bolt and, if the mechanical code established on the blade of the key is also correct, the mechanical bolt will be released and the opening operation may take place.

In practice, this requires an electric connection to be physically produced at some time during the opening operation between the respective contacts of the electronic circuits of the key and the lock; and the way in which such electric connection will be produced will depend upon the concrete arrangement of said electronic circuits and their contacts.

The object of this invention consists specifically of a new and advantageous arrangement of the contacts and electronic circuit incorporated in the key, determining an also new and advantageous arrangement of the contacts incorporated in the lock.

PRIOR STATE OF THE ART

All of the advances and improvements made in locks are always primarily intended to obtain ever greater security against tampering.

Electronic locks, the electronic circuits of which provide greater security than conventional locks, require in turn the adoption of special protection measures for these newly incorporated electronic circuits.

The attacks to which these electronic locks are subject can be typified as mechanical attacks and electronic attacks. Mechanical attacks are directed at physically damaging the contacts of the electronic circuits and electronic attacks are intended to disable the circuit by means of application of over-voltages.

The circuits are easily self-protectable electrically against electronic attacks and raise no serious problem, while mechanical attacks are more difficult to combat, since protection solutions have to be sought that are compatible with the key-switch electronic connection by means of physical electric contact and with the rotating operation to release the mechanical bolt.

One of the devices known today is that of European Pat. No. 238,359 of Emhart Industries, Inc., covering system of electronic closure with the key, in which the electronic circuit of the key is incorporated in its working blade, next to its end, and with the contacts connected to one of the edges, which is thus converted into an electrically active edge that, with the key inserted, coincides with contacts located in the key hole or way and belonging to the electronic circuit of the lock.

In this device the depth in the location of the contacts incorporated in the lock rotor does not prevent them from being reached and damaged through the key way, with the probable result of disabling the lock, which is at the same time prone to the accumulation of dirt and moisture that can impair correct operation. On the other hand, the location of the circuit occupying the thickness of the key blade practically prevents the application of flat keys, in which the thickness of the blade is used to provide tracks of different depths that form the mechanical locking code.

Another known device is that the one covered jointly by French Pat. No. 8503783 (key) and No. 8511180 (lock) of Bauer Kaba, AG, in which, in one place on the blade inserted inside the rotor of the lock, the key has fixed electric contacts that encircle it, affecting the two edges of the blade and one of the wide faces; for its part, the lock has matching moving contacts, like a circlip, that surround the rotor and define two open branches which, being tangent to the rotor, converge without entering the key hole.

In this device, with simple insertion of the key, the electric contact necessary for establishing the electronic code validating connection is not yet produced between key and lock; this electric contact will only take place once the turning operation is started, when the contacts of the edges of the key touch the convergent branches of the circlip contacts of the lock.

This device has eliminated the contacts of the key hole, but, on the other hand, complicates operation and adopts a complex configuration in which, in addition to not fully guaranteeing the inviolability of the contacts (access could be gained with some tool through the key hole), moving contacts are resorted to in the lock which are likely to deteriorate with use, giving rise to costly disabling of the lock.

A major disadvantage of this device, pointed to above, relates to its operation and consists of the fact that the keylock electronic connection is established when the turning operation is already started, so that if for any reason the electronic code is not validated, a shock will be produced against the electric bolt, which may be damaged. On the other hand, this arrangement makes it possible for the function to be affected by the spread at which the rotating operation is carried out, so that, this being a possibly very rapid operation, it can be the cause of an erroneous reading that would result in an undesired shock against the electric bolt.

EXPLANATION OF THE INVENTION AND ADVANTAGES

The object of this invention is an electronic key of a new and advantageous design, according to which between the drive head and the turning blade inserted in the rotor of the lock the key has an intermediate zone, on the edges of which there are retractile contacts charged by springs in corresponding housings, in which these retractile contacts are joined to conducting plates that come through the head from the electronic circuit integrated in the drive head itself, and on the insertion and turn of the key in the lock these retractile contacts enter into connection with fixed contacts of the corresponding electronic circuit of the lock that are included in the interior wall of an annular extension of the stator in front of the rotor of the lock.

According to the invention, the retractile contacts are formed with a projecting head and an inner shank, the projecting head having a retaining collar opposite the notched mouth of the corresponding housing and the inner shank being capable of being guided into a narrowed part of said housing, while this inner shank serves as a guide and support for a spring mounted between said retaining collar and the front of said narrowed part of the housing.

Another characteristic of the invention consists of the fact that the retractile contacts, the conducting plates and the electronic circuits are defined in a case mounted in relation to the neck and shank which, behind the inserting blade, form with the latter a structural single-piece body in which said neck and shank are opposite said intermediate zone and drive head.

Another characteristic of the invention consists of the fact that the conducting plates are located with dimensional play in grooves machined inside the case along the intermediate zone, extending from the housings of the retractile contacts to electric access passages to the electronic circuit.

The essential quality of this new design resides in the generation of moving contacts in the key that are operationally in front of the rotor of the cylinder, so that this rotor ceases to be an objective of the mechanical attacks mentioned and protection is also afforded the lock, which is the most expensive part and will now only require a generation of the annular projection bearing the contacts of the electronic circuit of the lock, which are and can be very resistant fixed and sturdy contacts, since physical establishment of the electric contact is secured by the elastic pressure of the retractile contacts mounted on the key.

The principal advantages of the arrangement recommended can be summarized as follows:

absence of moving parts (contacts) in the lock, which means less wear, greater operating security and longer lifetime of the lock;

greater structural simplicity;

elimination of extraneous handling of the rotor of the lock;

the electronic connection is produced at the same time as the key is inserted and the code can be validated before starting the turn, thereby eliminating the problems of overly rapid reading and protecting the electric bolt from damage by shock;

in relation to the foregoing point, the possibility exists of establishing two electric bolts, one unlockable at the time the correct key is inserted, without yet starting the turn, and the other unlockable at the end of the operation, after mechanical unbolting has occurred;

use of two single moving contacts on the key and two other fixed contacts on the lock;

making the electronic part of the key independent from the blade insertable in the rotor, thus being fully available for recording of the mechanical code;

paradoxically, greater protection from moisture and dirt, since, although the contacts of the lock are now more exposed to the outside, it is also certain that this favors self-drying and access for intentional drying and cleaning.

As for the possibility of electronic attack by application of overvoltages, accessibility to the contacts of the lock is no problem, for, as has already been stated at the beginning, this form of attack is self-protectable by electronic means, since it is something present in any electronic circuit and is amply overcome.

DRAWINGS AND REFERENCES

To understand the nature of this invention better, we are representing on the enclosed plans one preferred industrial embodiment, which is merely illustrative and not limitative.

Figure 3:
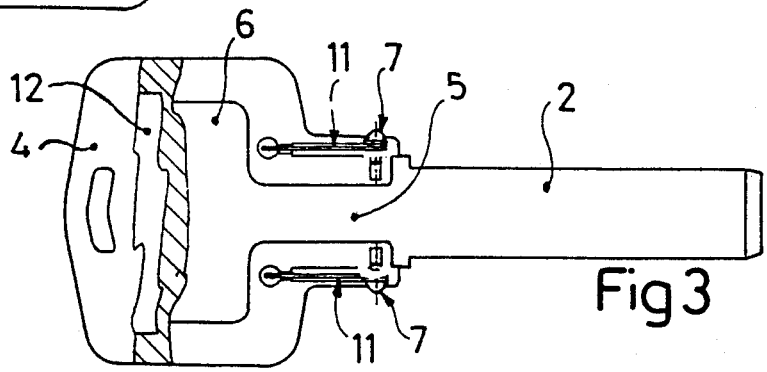
FIG. 3 is a similar view showing the electronic key now assembled and with the head (1) conventionally sectioned.
Figure 4:
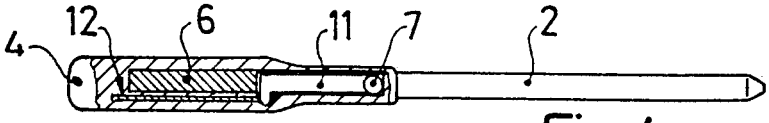
FIG. 4 is a conventionally sectioned profile view corresponding to FIG. 3.
Figure 8:
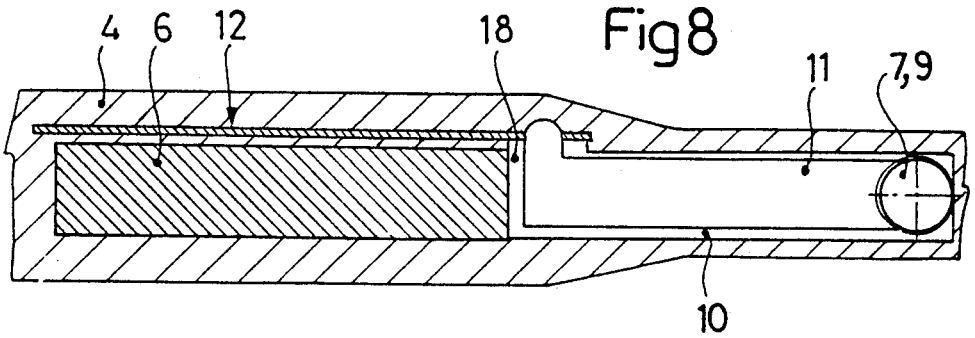
Figure 6:
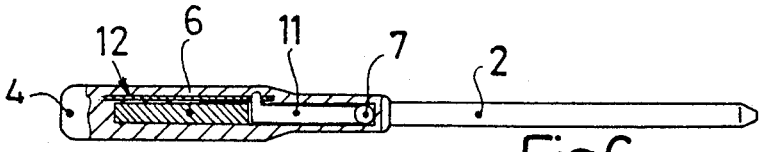
Figure 5:
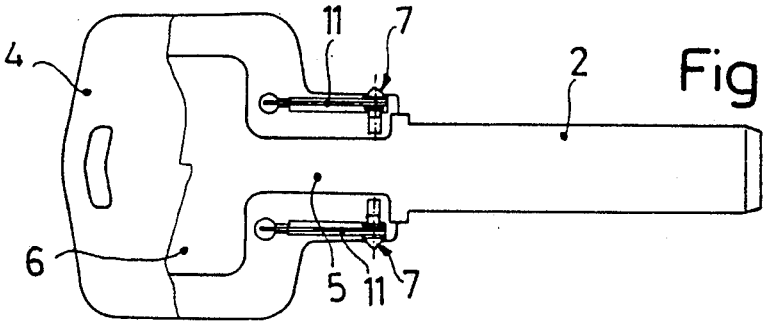
Figure 7:
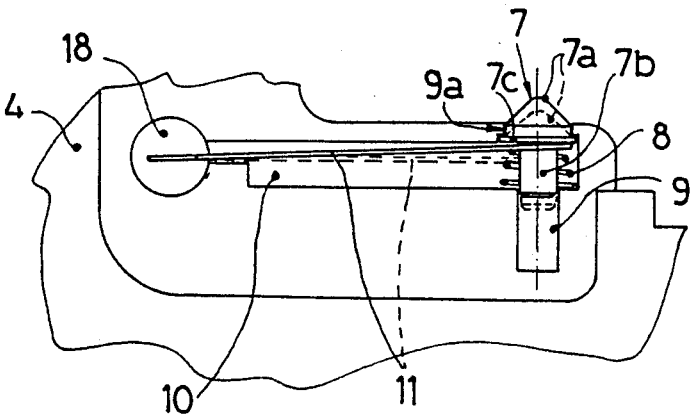

FIGS. 5 and 6 are views similar to FIGS. 3 and 4 and they are surrounded by details that have been expanded upon in FIGS. 7 and 8 respectively.

FIGS. 9 and 10 respectively show the electronic key incompletely inserted and totally inserted in the respective cylinder.

FIGS. 11 and 12 are respective expansions of details surrounded in FIGS. 9 and 10, pertaining to nonoperation and operation of the retractile contacts (7).

On these figures the following references are indicated:

1. Drive head
2. Blade
3. Intermediate zone
4. Case
5. Neck
6. Shank
7. Retractile contacts
**7*a*. Projecting head of contacts (7**)
**7*b*. Inner shank of contacts (7**)
**7*c*. Retaining collar of contacts (7**)
8. Springs
9. Housings
**9*a***. Notched mouth of housings
10. Channels
11. Conducting plates
12. Electronic circuit
13. Rotor
14. Stator
15. Key hole
16. Annular extension
17. Fixed contacts
18. Passage

PRESENTATION OF A DETAILED APPLICATION

Figure 1:
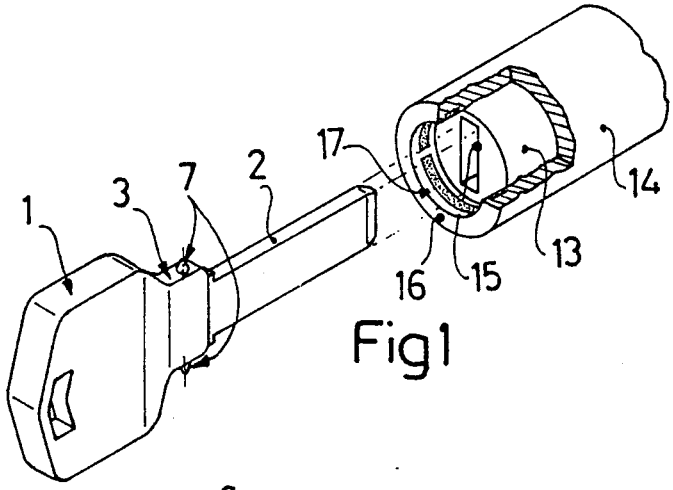
FIG. 1 is a perspective that shows the electronic key recommended opposite the cylinder of the lock.

On the drawings a preferred embodiment of the invention is illustrated, referred to an electronic key in which (FIG. 1) the following three parts are differentiated: a drive head (1), containing the corresponding electronic circuit (12) inside; a blade (2) intended for recording of the mechanical code, which is what is inserted in the channel (15) of the rotor (13) of the lock; an intermediate zone (3) that possesses on its edges retractile contacts (7) belonging to said electronic circuit (12) and intended to operate in relation to other fixed contacts (17) included in the interior wall of the annular extension (16) connected to the stator (14) of the lock.

Figure 2:
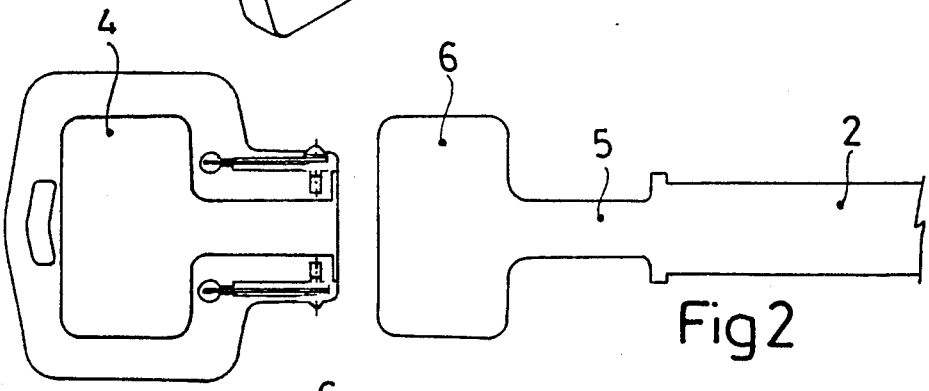
FIG. 2 shows in plan the two basic components of the electronic key separated.

Basically, the key is formed (FIGS. 2 and 3) by the combination of two components, one of which is a single-piece steel body that provides the structural rigidity and forms the blade (2) and, behind the latter, a neck (5) coinciding with said intermediate zone (3) of the key, followed by a shank (6) that provides the structural support of the drive head (1); the other component is a plastic case (4), consisting of two weldable covers, containing the electronic circuit (12) as well as the retractile contacts (7) and the conducting plates (11) which establish electric continuity between said contacts (7) and the circuit (12).

The retractile contacts (7) each consist (FIGS. 5 to 8) of a projecting head (7*a*) which, by means of a collar (7*c*), is retained in the notched mouth (9*a*) of the housing (9), and of an interior shank (7*b*) that guides displacement in a narrowed part of the housing (9) and that at the same time serves as a guide for a contractile spring (8) between the mouth of the narrowed part of the housing (9) and the retaining collar (7*c*) of the contact (7).

Joined to the retractile contacts (7) are conducting plates (11) that extend along channels (15) which make possible a dimensional play consistent with the operating displacement to be carried out by the contacts (7) and these channels open out into passages (18) through which the conducting plates (11) establish the connection with the electronic circuit (12).

The operation of the retractile contacts (7), with their conducting plates (11), is illustrated on FIGS. 9 to 12, where one can clearly appreciate the projecting position (FIG. 11) and retracted position (FIG. 12) corresponding respectively to the position of the key removed from and inserted in the lock.

These figures also very clearly show the advantageous working arrangement whereby operation of the retractile contacts (7) is produced outside, in front of the rotor (13), in relation to sturdy fixed contacts (17) firmly included in the wall of the annular extension (16) connected to the stator (14).

The nature of this invention having been sufficiently described, it is only to be added that, in the unit as a whole and in its components, it is possible to introduce changes of form, material and arrangement within the scope of the invention, as long as such variations do not depart from the principle thereof.

I claim:

1. In an electronic locking device comprising a key and a lock, the improvement comprising:

(a) a drive head (1) on the key, the drive head having an electronic circuit (12) therein;

(b) a blade (2) on the key, (c) a stator (14) in the lock, the stator having a rotor (13), the stator surrounding the rotor (13), the stator having an annular extension (16) with an interior wall, the interior wall having an electronic circuit corresponding to the electronic circuit in the drive head, the corresponding electronic circuit having fixed contacts (17) therein;

the key having an intermediate zone (3) with edges, the edges having retractile contacts (7) charged by means of springs (8) in corresponding housings (9), in which said retractile contacts (7) are joined to conducting plates (11) that extend through the head (1) from the electronic circuit (12) and on the insertion and turn of the key in the lock, the retractile contacts (7) come into contact with the fixed contacts (17) of the corresponding electronic circuit in the interior wall of the annular extension (16) of the stator (14).

2. The electronic locking device of claim 6 wherein the retractile contacts (7) are formed with a projecting head (7*a*) and an inner shank (7*b*) and the housing (9) has a notched mouth (9*a*), the projecting head (7*a*) having a retaining collar opposite the notched mouth (9*a*) and the inner shank (7*b*) being capable of being guided into a narrowed part of said housing (9), while the inner shank (7*b*) serves as a guide and support for a spring (8) mounted between said retaining collar (7*c*) and the front of said narrowed part of the housing (9).

3. The electronic locking device of claim 2 wherein the key has a neck (5) and a shank (6) and the retractile contacts (7), the conducting plates (11) and the electronic circuit (12) are in a case (4) mounted in relation to the neck (5) and the shank (6) which, behind the blade (2), form with the blade a structural single-piece body in which said neck (5) and shank (6) are opposite the intermediate zone (3) and the drive head (1).

4. The electronic locking device of claim 3 wherein the case (4) has grooves (10) and electric access passages (18) to the electronic circuit (12) therein and the conducting plates (11) are located with dimensional play in the grooves (10) along the intermediate zone (3), extending from the housings (9) of the retractile contacts (7) to the electric access passages (18).

* * * * *

UNITED STATES PATENT AND TRADEMARK OFFICE

CERTIFICATE OF CORRECTION

PATENT NO. : 4,947,662

DATED : August 14, 1990

INVENTOR(S) : Juan Antonio-Imedio

It is certified that error appears in the above-identified patent and that said Letters Patent is hereby corrected as shown below:

Column 6, line 16, change "claim 6" to --claim 1--.

Signed and Sealed this

Thirty-first Day of December, 1991

*Attest:*

HARRY F. MANBECK, JR.

*Attesting Officer*

*Commissioner of Patents and Trademarks*